US006777035B1

(12) United States Patent
Grinberg et al.

(10) Patent No.: US 6,777,035 B1
(45) Date of Patent: Aug. 17, 2004

(54) METHOD FOR SPRAY FORMING METAL DEPOSITS

(75) Inventors: Grigoriy Grinberg, Sylvania, OH (US); Allen Dennis Roche, Saline, MI (US); David Robert Collins, Saline, MI (US); Richard L Allor, Livonia, MI (US)

(73) Assignee: Ford Motor Company, Dearborn, MI (US)

( * ) Notice: Subject to any disclaimer, the term of this patent is extended or adjusted under 35 U.S.C. 154(b) by 4 days.

(21) Appl. No.: 10/248,692

(22) Filed: Feb. 10, 2003

(51) Int. Cl.[7] ..... C23C 4/08

(52) U.S. Cl. ..... 427/455; 427/446; 427/456; 427/422; 164/46

(58) Field of Search ..... 427/446, 455, 427/456, 422; 164/46

(56) References Cited

U.S. PATENT DOCUMENTS 5,337,631 A 8/1994 Singer et al.
5,718,863 A 2/1998 McHugh et al.
5,952,056 A * 9/1999 Jordan et al. ..... 427/455
6,074,194 A 6/2000 McHugh
6,155,330 A 12/2000 Kinane et al.
2002/0153118 A1 * 10/2002 Roche et al. ..... 164/46

* cited by examiner

*Primary Examiner*—Katherine A. Bareford
(74) *Attorney, Agent, or Firm*—Brooks Kushman PC; Damian Porcari

(57) ABSTRACT

One method of the present invention relates to a method for spray forming metal deposits. The method is comprised of providing a ceramic substrate having a spraying pattern for receiving sprayed metal particles, spraying metal particles onto the spraying pattern to form a metal deposit on the spraying pattern for at least a first spray period, controlling the spraying step during the first spray period so that the temperature of the deposited metal particles increases at an average rate of less than or equal to about 15° per minute. The first spray period can be defined as lasting until the temperature of the deposited metal particles is at or about a steady state temperature. The steady state temperature is preferably in the range of about 330° C. to about 370° C.

23 Claims, 2 Drawing Sheets

METHOD FOR SPRAY FORMING METAL DEPOSITS

BACKGROUND OF THE INVENTION

1. Field of the Invention

One aspect of the present invention generally relates to methods for producing prototype tools and, more specifically, to methods for spray forming metal deposits.

2. Background Art

Spray forming has become an accepted technique for producing prototype tooling, i.e., dies and molds, in substantially less time than needed to make prototype tooling conventionally. The typical spray forming technique includes the following steps: (1) casting a ceramic substrate containing a spraying pattern about a mold containing a master pattern of the tool to be produced; (2) preheating the ceramic substrate; (3) spraying metal particles onto the substrate containing the spraying pattern; (4) allowing the sprayed metal particles to form a metal deposit having the general shape of the master pattern; and (5) separating the metal deposit from the ceramic substrate.

During the early stages of the spraying step, a thin shell of sprayed metal is deposited onto the spraying pattern. Significant thermal gradients can form across the thin shell. The formation of thermal gradients can be largely attributed to the following factors: (1) the difference between the temperature of the spraying pattern and the deposited metal particles, and (2) the superior insulating properties of the ceramic substrate. Typically, the ceramic substrate is preheated to about 250° C. During the initial stages of the spraying step, the temperature of the thin shell and spraying pattern can typically reach temperatures of about 350° C. The significant amount of heat associated with these temperatures is not dissipated through the ceramic substrate due to its superior insulating properties. Most of the heat generated by the sprayed metal particles is contained in the metal deposit.

The significant thermal gradients can cause the thin shell to separate from the spraying pattern, causing surface imperfections, i.e., wrinkles and/or cracks, in the metal deposit. After separating the metal deposit from the ceramic substrate, the surface imperfections have to be corrected with additional processing steps so that the metal deposit is suitable for prototype tooling. For example, a welding material can be (1) welded onto the surface imperfection, and (2) ground to reflect the general shape characteristics of the master pattern. As another example the surface imperfection can be smoothed and filled with a filler material, i.e., metal filled epoxy. In some cases, the surface imperfections are so extreme that the metal deposit is unsuitable for prototype tooling and must be scrapped.

To avoid the cost and time associated with the additional processing steps and scrapping, a method for spray forming metal deposits that minimizes the formation of surface imperfections is needed.

SUMMARY OF THE INVENTION

At least one aspect of the present invention is related to methods for spray forming metal deposits.

One aspect of the present invention includes providing a ceramic substrate having a spraying pattern for receiving sprayed metal particles, spraying metal particles onto the spray pattern to form a metal deposit on the spraying pattern for at least a first period, and controlling the spraying step during the first spray period so that temperature of the deposited metal particles increase at an average rate of less than or equal to about 15° C. per minute. The first spray period lasts until the temperature of the deposited metal particles is at or about a steady state temperature. In accordance with the preferred embodiment, the controlling of spraying step comprises using at least one thermal spray gun to spray metal particles. The current of at least one thermal spray gun can increase from a first ampere value towards the second ampere value during the first spray period. The first ampere value can be 150 amperes and the second ampere value can be 220 amperes. The wire feed rate of at least one thermal spray gun can be increased from a first value to a second value during the first spray period. The first value can be about 15 pounds per hour and the second value can be about 22 pounds per hour. The steady state temperature can be about 330° C. to about 370° C. Preferably, the metal particles are comprised of carbon steel.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings which:

DETAILED DESCRIPTION OF THE PREFERRED EMBODIMENT(S)

As required, detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

One aspect of the present invention provides a method comprising at least three basic steps: (a) providing a substrate having a spraying pattern for receiving sprayed metal particles, (b) spraying metal particles onto the spraying pattern to form a metal deposit on the spraying pattern for at least a first spray period, the first spray period lasting until the temperature of the deposited metal particles reaches a steady state temperature, and (c) controlling the spraying step (b) during the first spray period so that the temperature of the deposited metal particles increases at an average rate of less than or equal to about 15° C. per minute.

Figure 1:
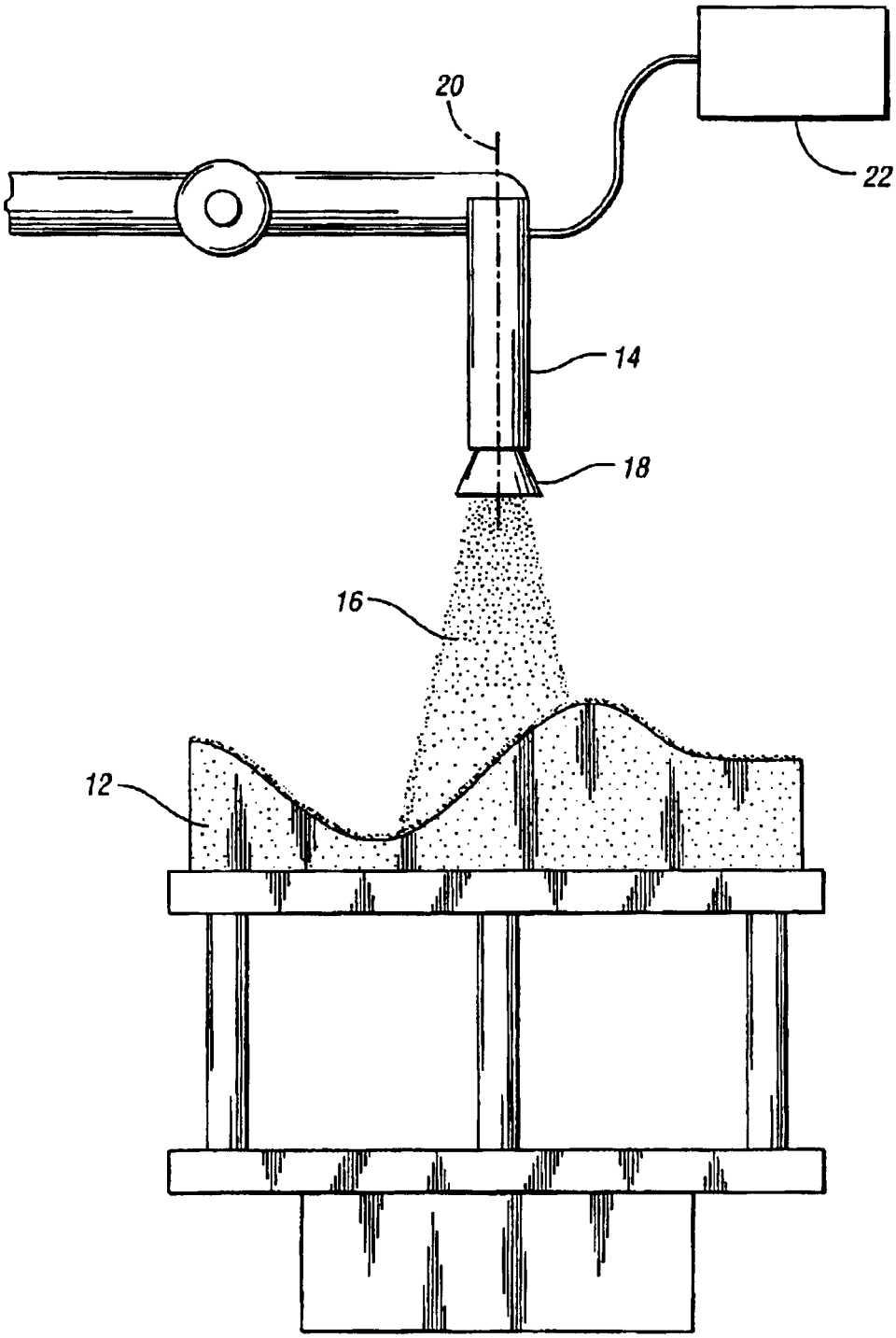
FIG. 1 is a schematic illustration of an apparatus used in a spray forming process of the present invention.

The substrate 12, shown schematically in FIG. 1, is preferably a ceramic substrate produced using a freeze-casting process. One typical freeze-casting process includes the following steps: (1) pouring a slurry into the mold containing a master pattern, (2) lowering the temperature of the slurry to freeze the slurry and form the ceramic substrate containing the spraying pattern, (3) extracting the substrate from the mold, (4) thawing the ceramic substrate, and (5) drying the ceramic substrate during the firing cycle. After completing step (5), the spraying pattern is ready to receive sprayed metal particles.

In accord with a preferred embodiment of the present invention, metal particles can be sprayed onto the spraying pattern using spray forming. Examples of materials suitable for being sprayed using spray forming include, but are not limited to, pure metals, i.e., zinc, aluminum, and copper, and metal alloys, i.e., tin alloys, zinc alloys, aluminum alloys, copper alloys, bronze, steel, brass, and stainless steel. A particularly preferred material for spray forming is 0.8 carbon steel, available from Praxir Surface Technologies of Indianapolis, Ind. It should be understood that spray forming can refer to any technique used to deposit metal particles upon a substrate. Spray forming techniques that can be used in accord with the present invention include, but are not limited to spray-rolling, spray-forging, centrifugal spray-casting, spray-casting, spray-peening, splat-coating, particle composite deposition, roller atomizing, modified arc spray, and modified plasma-spraying.

As shown schematically in FIG. 1, one or more thermal spray gun(s) 14 are preferably utilized to spray metal particles 16 onto the spraying pattern of substrate 12. Thermal spray gun 14 can be of the oxy-acetylene flame type in which a wire or powder metal is fed there into, a plasma-type into which powder metal is fed, or preferably one or two wire arc type, in which the tip of the wires is fed into the arc. In addition, high-energy plasma-spraying, vacuum plasma-spraying, detonation, and high-velocity oxyfuel techniques can be utilized.

In a two wire arc spray gun, an electric arc is generated in a zone between two consumable wire electrodes; as the electrodes melt, the arc is maintained by continuously feeding the electrodes into the arc zone. The metal at the electrode tips is atomized by a blast of generally cold compressed gas. The atomized metal is then propelled by the gas jet to a substrate forming a deposit thereon.

In a single wire arc apparatus, a single wire is fed either through the central axis of the torch or is fed at an acute angle into a plasma stream that is generated internally within the torch. The thickness of the wire used in the typical spray forming operation is preferably in the range of about 1/16 inches to about 1/18 inches and most preferably about 1/16 inches. The single wire acts as a consumable electrode that is fed into the arc chamber. The arc is established between the cathode of the plasma torch and the single wire as an anode, thereby melting the tip of the wire. Gas is fed into the arc chamber, coaxially to the cathode, where it is expanded by the electric arc to cause a highly heated gas stream (carrying metal droplets from the electrode tip) to flow through the nozzle. A further higher temperature gas flow may be used to shroud or surround the spray of molten metal so that droplets are subjected to further atomization and acceleration.

Yet still other wire arc torch guns may be utilized that use a transferred-arc plasma whereby an initial arc is struck between a cathode and a nozzle surrounding the cathode; the plasma created from such arc is transferred to a secondary anode (outside the gun nozzle) in the form of a single or double wire feedstock causing melting of the tip of such wire feedstock.

In the preferred embodiment shown in FIG. 1, a thermal spray gun 14 has a gun tip 18 which is oriented along an axis 20 perpendicular to the general planar extent of the base of the freeze-case substrate. The thermal spray gun 14 has a power supply 22 that can be operated at about 30 volts and a current of about 50 amperes to about 350 amperes. Thermal spray gun 14 is supplied with a high pressure gas from their respective supplies consisting of nitrogen, air, or a mixture thereof, at a pressure of about 40 to about 120 p.s.i. The gas is used to affect the atomization of the wire droplets.

According to a preferred embodiment of the present invention, the metal particles are sprayed onto the spraying pattern for at least a first spray period and a second spray period. The first spray period begins when spraying beings and lasts until the temperature of the deposited metal particles reaches about a steady state temperature. The second spray period begins when the temperature of the deposited metal particles reaches about the steady state temperature and lasts until spraying ends. The temperature of the deposited metal is at or near the steady state temperature during the second spray period. For the majority of the total spray period, the temperature of the deposited metal particles is at or near the steady state temperature. The steady state temperature is preferably between about 330° C. and 370° C., and most preferably about 350° C.

Prior to spraying the metal particles onto the spraying pattern, substrate 12 can be pre-heated to affect suitable adhesion characteristics. For instance, the ceramic substrate can be preheated to about 250° C. In addition to the preheating temperature, the adhesion of the sprayed metal particles onto the spraying pattern depends on the temperature of the deposited metal particles. The temperature of the deposited metal particles is largely dependent upon the operating parameters (i.e., supplied amperage or wire feed rate) of thermal spray gun(s).

Figure 2:
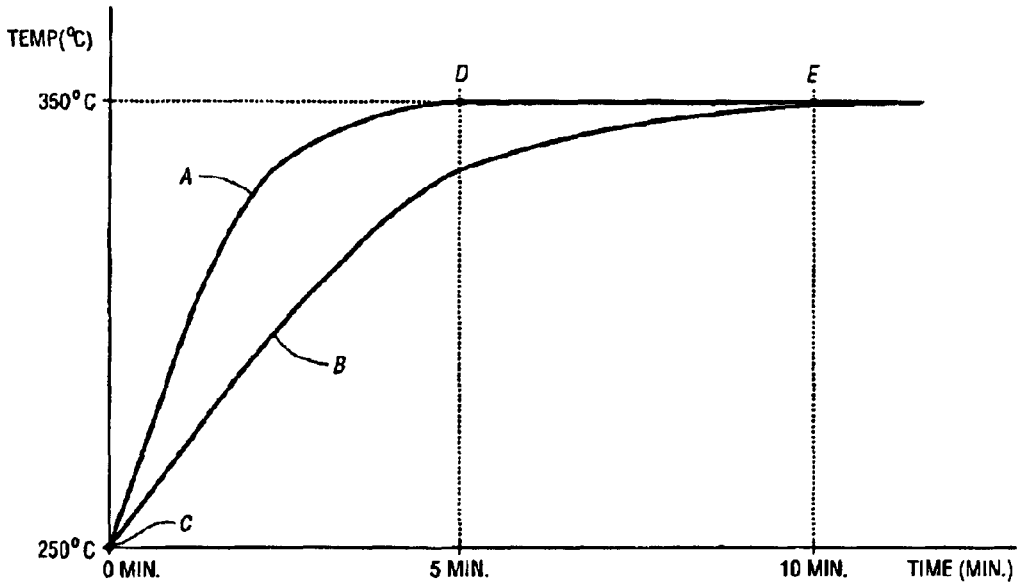
FIG. 2 is a graph that depicts the temperature of deposited metal particles as a function of spraying time for two different spray forming processes (A) and (B).

According to a preferred embodiment, the spray step is controlled during the first spray period to minimize surface imperfections. FIG. 2 is a graph that depicts the temperature of the deposited metal particles as a function of spraying time for two different spray forming processes A and B. Process A is a prior art process that commonly leads to surface imperfections. Process B is an example of an improved process that minimizes surface imperfections.

Curve A of FIG. 2 depicts the temperature of the deposited metal particles as a function of spraying time for process A. At point C on curve A, the operating parameters of the thermal spray gun(s) are set to achieve a desired ramp rate for the initial metal deposit. For example, the amperage of the thermal gun(s) can be set to about 170 amperes, or alternatively, the wire feed rate can be set to about 17 pounds/hour. It should be understood that the amperes and feed rates can vary depending on several parameters, i.e., substrate size, amount of guns, spray pattern geometry, pre-heat temperature, and deposit efficiency. Before reaching point D on curve A, the operating parameters of the thermal spray gun(s) are adjusted to increase the deposited metal temperature to the steady state temperature. For example, the amperage of the thermal gun(s) can be adjusted from about 170 amperes to about 220 amperes, or alternatively, the wire feed rate can be adjusted from about 17 pounds/hour to about 22 pounds/hour. The first spray period begins at about point C and ends at about point D, and lasts about 5 minutes. The second spray period begins at about point D and lasts until the spraying process is completed.

Process A can produce surface imperfections in the metal deposit during the initial stages of spraying due to the significant stress created by significant thermal gradients across the metal deposit. Correcting the surface imperfections can require additional process steps in order to make the deposit suitable for prototype tooling. In extreme cases, the surface imperfections are so severe that the metal deposit is scrapped.

It has been discovered that by increasing the spraying time necessary to reach the steady state temperature relative to the prior art, surface imperfections can be minimized. In other words, the rate at which the temperature of the deposited metal increases over spraying time (ramp rate) is decreased. The adjustment greatly reduces the amount of separation, and therefore the amount of cracks and wrinkles that form during the initial stages of the spray forming process.

Curve B depicts the temperature of the deposited metal particles as a function of spraying time for a preferred embodiment of the present invention. At point C on curve B, the operating parameters of the thermal spray gun(s) are set to achieve a desired ramp rate for the initial metal deposit. For example, the amperage of the thermal gun(s) can be set to about 150 amperes, or alternatively, the wire feed rate can be set to about 15 pounds/hour. Before reaching point E on curve B, i.e., reaching the steady state temperature, the amperage of the thermal gun(s) can be adjusted from about 150 amperes to about 220 amperes, or alternatively, the wire feed rate can be adjusted from about 15 pounds/hour to about 22 pounds/hour. The first spray period begins at about point C and ends at about point E, and lasts about 10 minutes. Therefore, the average ramp rate for the first spray period is about 10° C. per minute of spraying time.

It should be understood that the average ramp rate of the first spray period can be about 15° C. per minute in order to reduce the occurrences of surface imperfections depending on operating conditions. It should be understood that the ranges of operating parameter ramping values, i.e., amperes and wire feed rates, to deliver the ramp rates suitable for minimizing surface imperfections can vary depending on several parameters, i.e., substrate size, amount of guns, spray pattern geometry, preheating temperature, and deposit efficiency.

While the best mode for carrying out the invention has been described in detail, those familiar with the art to which this invention relates will recognize various alternative designs and embodiments for practicing the invention as defined by the following claims.

What is claimed:

1. A method for spray forming metal deposits, the method comprising:

(a) providing a substrate having a spraying pattern for receiving sprayed metal particles;

(b) spraying metal particles onto the spraying pattern to form a metal deposit on the spraying pattern for at least a first spray period, the first spray period lasting until the temperature of the deposited metal particles is at or about a steady state temperature; and (c) controlling the spraying step (b) during the first spray period so that the temperature of the deposited metal particles increase at an average rate of less than or equal to about 15° C. per minute.

2. The method of claim 1 wherein the substrate is comprised of a ceramic substrate.

3. The method of claim 2 wherein the controlling of spraying step (b) comprises using an at least one thermal gun to spray metal particles.

4. The method of claim 3 wherein the current of the at least one thermal spray gun is increased from a first ampere value towards a second ampere value during the first spray period.

5. The method of claim 4 wherein the first ampere value is about 150 amperes and the second ampere value is about 220 amperes.

6. The method of claim 3 wherein the wire feed rate of the at least one thermal spray gun is increased from a first value to a second value during the first spray period.

7. The method of claim 6 wherein the first value is about 15 pounds/hour and the second value is about 22 pounds/hour.

8. The method of claim 2 wherein the steady state temperature is about 330° C. to about 370° C.

9. The method of claim 8 further comprising (d) spraying metal particles onto the metal deposit for at least a second spray period lasting longer than the first spray period and being conducted at about the steady state temperature.

10. A method for spray forming metal deposits, the method comprising:

(a) providing a substrate having a spraying pattern for receiving sprayed metal particles;

(b) spraying metal particles onto the spraying pattern to form a metal deposit on the spraying pattern, (c) controlling the spraying step (b) during a first spray period lasting until the deposited metal particles are about a steady state temperature, so that the temperature of the deposited metal particles increases at a rate of less than or equal to about 15° C. per minute.

11. The method of claim 10 wherein the substrate is comprised of a ceramic substrate.

12. The method of claim 11 wherein the controlling of spraying step (b) comprises using an at least one thermal gun to spray metal particles.

13. The method of claim 12 wherein the current of the at least one thermal spray gun is increased from a first ampere value towards a second ampere value during the first spray period.

14. The method of claim 13 wherein the first ampere value is about 150 amperes and the second ampere value is about 220 amperes.

15. The method of claim 11 wherein the wire feed rate of the at least one thermal spray gun is increased from a first value to a second value during the first spray period.

16. The method of claim 15 wherein the first value is about 15 pounds/hour and the second value is about 22 pounds/hour.

17. The method of claim 11 wherein the steady state temperature is about 330° C. to about 370° C.

18. The method of claim 17 further comprising (d) spraying metal particles onto the metal deposit for at least a second spray period lasting longer than the first spray period and being conducted at about the steady state temperature.

19. A method for spray forming metal deposits, the method comprising:

(a) providing a substrate having a spraying pattern for receiving sprayed metal particles;

(b) spraying metal particles onto the spraying pattern to form a metal deposit on the spraying pattern for at least a first spray period, the first spray period lasting until the thickness of the metal deposit is about 1 millimeter; and (c) controlling the spraying step (b) during the first spray period so that the temperature of the deposited metal particles increase at an average rate of less than or equal to about 15° C. per minute.

20. The method of claim 19 wherein the substrate is comprised of a ceramic substrate.

21. The method of claim 20 wherein the controlling of spraying step (b) comprises using at least one thermal gun to spray metal particles.

22. The method of claim 21 wherein the current of at least one thermal spray gun is increased from a first ampere value towards a second ampere value during the first spray period.

23. The method of claim 22 wherein the first ampere value is about 150 amperes and the second ampere value is about 220 amperes.

* * * * *